US005390455A

United States Patent [19]

Antolini

[11] Patent Number: 5,390,455

[45] Date of Patent: Feb. 21, 1995

[54] SYSTEM FOR PROTECTING WOOD FRAME BUILDINGS FROM SEISMIC AND WIND FORCES

[76] Inventor: Douglas R. Antolini, 3525 Mt. Everest Blvd., San Diego, Calif. 92111

[21] Appl. No.: 951,103

[22] Filed: Sep. 25, 1992

[51] Int. Cl.[6] ..... E02D 27/00

[52] U.S. Cl. ..... 52/299; 52/295; 52/166; 52/292; 52/79.1; 52/693

[58] Field of Search ..... 52/251, 292, 295, 299, 52/79.1, 169.9, 693, 167 CB, 167 R, 699, 650.3, 293.1, 166

[56] References Cited

U.S. PATENT DOCUMENTS

| | | | |
|---|---|---|---|
| 641,206 | 7/1900 | Hedges | 52/488 |
| 1,537,186 | 5/1925 | Parrish | 52/319 |
| 2,086,650 | 7/1937 | Trout | 52/299 |
| 2,280,687 | 4/1942 | Connelly | 52/293.1 |
| 2,359,304 | 10/1944 | Davison | 52/299 |
| 4,027,439 | 6/1977 | Willard | 52/293.1 |
| 4,065,218 | 12/1977 | Biggane | 52/693 |
| 4,282,619 | 8/1981 | Rooney | 52/650.3 |
| 4,441,289 | 4/1984 | Ikuo et al. | 52/167 |
| 4,570,403 | 2/1986 | Dannemiller | 52/295 |
| 4,615,157 | 10/1986 | Murry | 52/167 |
| 4,649,688 | 3/1987 | Mosier | 52/693 |
| 4,909,001 | 3/1990 | Gonzalez Espinosa de Los Monteros | 52/251 |
| 5,072,570 | 12/1991 | Johnson | 52/747 |
| 5,150,553 | 9/1992 | Commins et al. | 52/699 |

*Primary Examiner*—Carl D. Friedman
*Assistant Examiner*—Winnie Yip

[57] ABSTRACT

A system for modifying existing wood frame buildings to protect them from damage due to seismic and wind forces. At least one (preferably several) deadman is formed adjacent to a peripheral foundation that supports rim joists on foundation sill plates at the foundation and plural crossed beams and floor framing joists. The deadman preferably comprises concrete. A plurality of transfer blocks and compression blocks are fastened along said rim joists between at least some of the framing joists. Elongated transfer ties are secured to the transfer blocks and pass adjacent to the deadman. At least one anchor embedded in the deadman and is fastened to the transfer tie. At least one additional anchor may be secured to the deadman and fastened to an adjacent framing joist. Framing joists preferably have short tie straps overlapping all joist connections and fastened to the joists. Exterior wall covering material may be removed adjacent to the foundation sill plate and any wall sill plates. Elongated tie straps are then fastened along those plates. Anchor means may be fastened to those tie straps and be embedded in the deadmen. The deadmen are preferably cast in place with the anchors partially embedded in the deadman during casting.

13 Claims, 9 Drawing Sheets

SYSTEM FOR PROTECTING WOOD FRAME BUILDINGS FROM SEISMIC AND WIND FORCES

BACKGROUND OF THE INVENTION

This invention relates in general to the protection of wood frame buildings against seismic and wind forces and, more particularly, to a system which can be applied to existing wood frame building to provide such protection.

Modern building constructed over the last several years in areas prone to seismic activity or high winds are provided with protection against those forces. Sturdy foundations and a variety of systems for tieing the building together and to the foundation are generally provided. In other cases, particularly with large buildings, various "floating" supports are provided, allowing the building to move or sway in response to seismic forces without damage.

Older buildings, mobile homes and the like are generally not well secured to their foundations and are prone to moving off their foundations during earthquakes or high winds such as tornadoes or hurricanes. Retrofiring these existing buildings to the standards for new construction is generally prohibitively expensive.

Even where older buildings were originally well fastened to their foundations, with time those fastening arrangements have often deteriorated. Building foundation mud sill plates on peripheral foundations often have studs embedded in the foundation extending through the sill plates with washers and nuts holding the sill plates to the foundation. Older building were often constructed with large aggregate and sandy cement concrete, what is now called rubble concrete. With time, the concrete weakens and crumbles, no longer holding bolts securely. The addition of more fasteners between foundation and building is generally ineffective where the foundation has deteriorated. The width of typical foundations is such that there is often only two inches of concrete on each side of a bolt. Also, many building foundation mud sill plates are not secured in any manner tho their foundations. Thus, in a earthquake the bolt may crack or split the foundation, allowing the structure to move off of the foundation, often causing total destruction. Further, even if the foundation is still sturdy, the sill plates may have deteriorated due to termites, dry rot or the like, increasing the chance of earthquake or wind damage.

A variety of bracing systems have been developed to try to tie buildings to foundations to resist seismic and wind forces. Typically, Biggane in U.S. Pat. No. 4,065,218 provides a reinforcement in which a channel iron is connected through articulated ends to a structure and to an object being supported, to provide support and flexibility. Ikue et al in U.S. Pat. No. 4,441,289 describes a compression brace system for diagonally reinforcing a pillar beam building. Murray in U.S. Pat. No. 4,615,157 discloses a system for damping oscillations in floor joists. Johnson in U.S. Pat. No. 5,072,570 discloses a brace bolted to the side of a concrete foundation and floor beams to tie them together. While effective in some cases, these arrangements are often difficult to apply to existing structures, are expensive and may require undeteriorated foundation and adjacent wooden structures and may not improve resistance to severe seismic forces and high wind forces.

Thus, there is a continuing need for improved systems for modifying existing wood frame structures to resist seismic and wind forces, which are inexpensive, effective, and can be easily applied to existing structures, even those which have deteriorating peripheral foundations and/or deteriorating wood in sill plates and similar components.

SUMMARY OF THE INVENTION

The above-noted problems, and others, are overcome in accordance with this invention by a system for protecting wood frame buildings having a peripheral foundation from seismic and wind forces which basically comprises at least one (preferably several in different walls) deadman formed adjacent to, or in contact with, the interior or exterior of the wall of the foundation. Each deadman is preferably constructed using cast-inplace concrete in a form and/or hole adjacent to the foundation, the volume of the deadman being selected in accordance with applicable building codes.

This system is useful with buildings having a plurality of parallel beams which support a plurality of transverse floor framing joists which support, in turn, the floor. At the perimeter and inline with the floor framing system a rim joist is provided.

Compression and transfer blocks, typically wood blocks or assemblies of the appropriate size and shape, are secured between at least some of the floor framing joists adjacent to the rim joist. A series of transfer tie straps are fastened to the bottom and/or sides of the blocks to provide continuous assemblies. Anchors connected to the transfer tie straps, typically curved transfer tie strap ends, are embedded in the deadman. Anchors may also be fasted to adjacent floor joists and embedded in adjacent deadmen.

Often, the floor framing joist elements are constructed from shorter pieces with an overlapping joint or a butt joint over a beam. A tie strap should preferably be fastened over the joint, with fasteners, such as bolts, passing entirely through the tie strap and both pieces making up the joint, or the lap joint may be laminated with the tie strap.

Foundation sill plates are generally provided on the upper surface of the foundation wall to support the array of beams and floor joists. Also, wall sill plates may be provided to support exterior walls above the foundation. Exterior wall covering material, such as stucco, may be removed to reveal the sill plates. Elongated tie straps are then fastened, such as by nails, along the sill plates. Anchors are provided at suitable locations with one end fastened to the sill plates, either or both of the foundation sill plates and wall sill plates, and have ends embedded in said deadmen.

This system strengthens the foundation, especially where several deadmen in different locations along the foundation area are used, resisting both seismic and wind loads and keeping the building on the foundation, despite possible deterioration of the original foundation.

BRIEF DESCRIPTION OF THE DRAWING

Details of the invention, and of certain preferred embodiments thereof, will be further understood upon reference to the drawing, wherein.

DETAILED DESCRIPTION OF PREFERRED EMBODIMENTS

Figure 1:
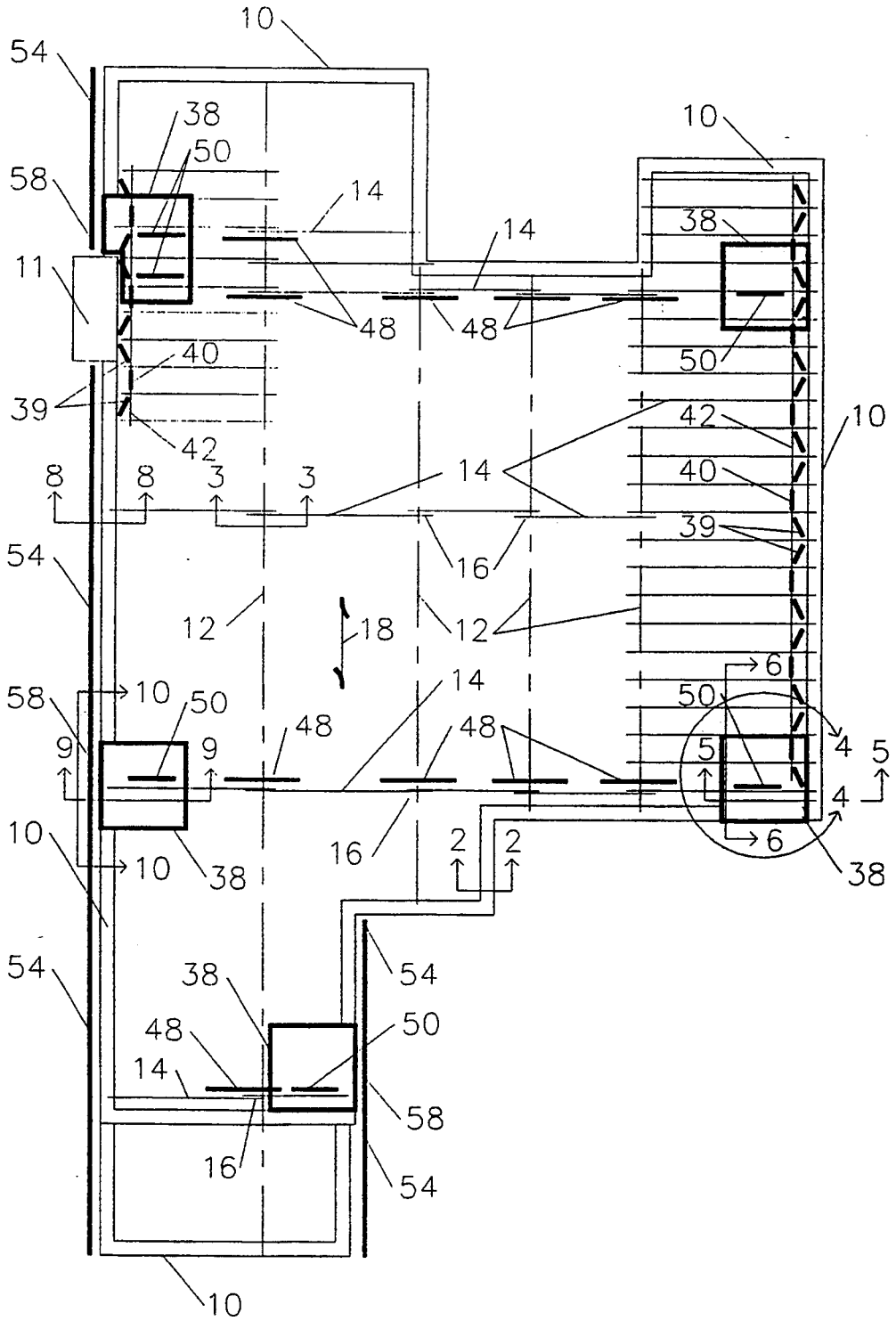
FIG. 1 is a schematic plan view of a structure foundation and substructure with the protective system of this invention in place.
Figure 3:
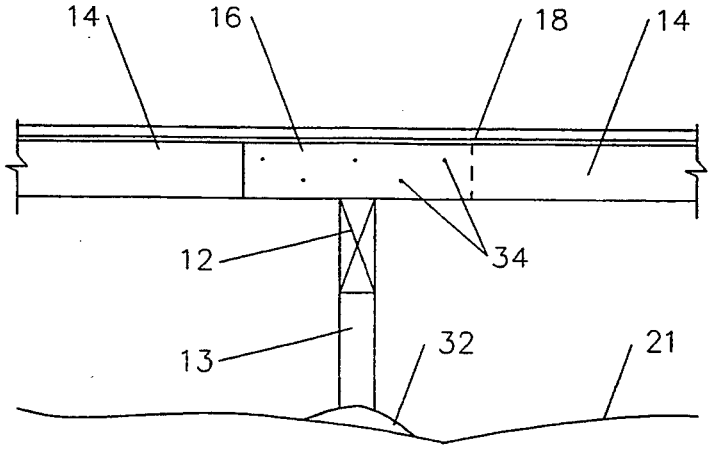
FIGURE 3 PRIOR ART
FIG. 3 is a detail section view taken on line 3—3 in FIG. 1, showing a prior art beam support arrangement.

Referring now to FIG. 1, there is seen a peripheral building foundation 10, typically formed from concrete, concrete block, cast-in-place concrete, mortared rock or brick, etc. A separate fireplace foundation 11 may be located adjacent to the exterior of foundation 10. Floor beams or girders 12 extend in a parallel array across foundation 10 in a first (here, vertical) direction as schematically indicated by broken lines 12. While beams 12 are generally continuous wood beams, they could also be steel, prestressed concrete, etc. The ends of beams 12 may be supported in a pocket in foundation 10 (not shown, but indicated in FIG. 1) and on posts 13 below the beams, as shown in FIG. 3.

Figure 2:
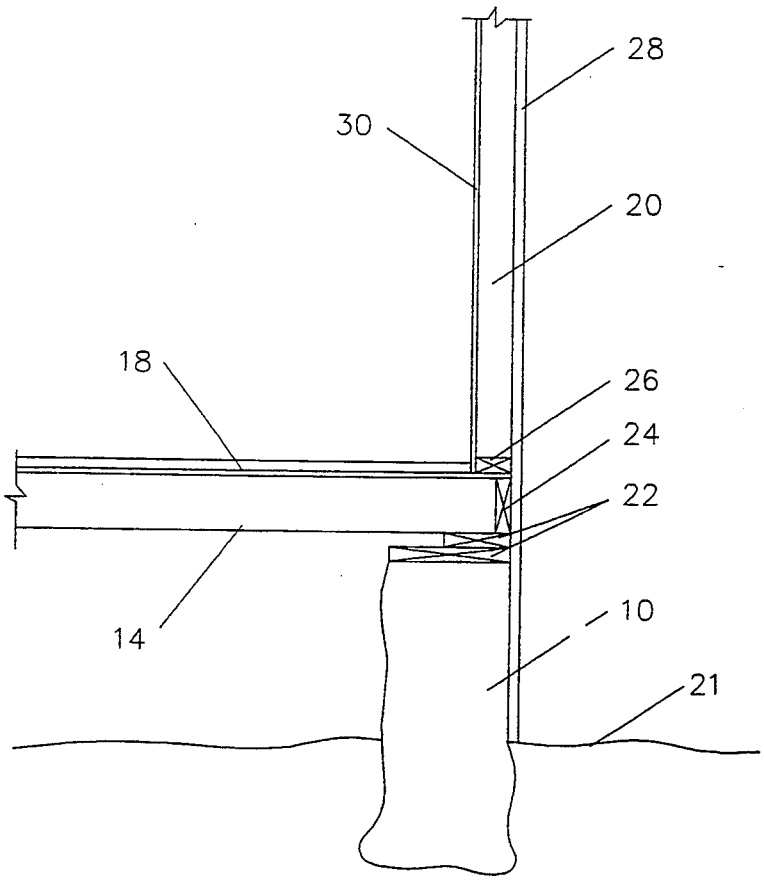
FIGURE 2 PRIOR ART
FIG. 2 is a detail section view taken on line 2—2 in FIG. 1 showing a floor framing foist and rim joist arrangement in accordance with the prior art.

A parallel array of floor framing joists 14 are arranged perpendicular to beams 12, horizontally as seen in FIG. 1. Joists 14 are generally wood. As schematically indicated, joists 14 are often relatively short, with sections fastened together at overlapping ends 16 by nails, screws, bolts or the like. Joists 14 may rest on foundation 10 as seen in FIG. 2, or where beams 12 are supported on posts 13 as seen in FIG. 3. Otherwise, where beams are supported by foundation 10, the ends of joists 14 would lie on a plate or plates 22 atop foundation 10.

The floor itself, or floor diaphragm 18, (typically plywood or wood boards as seen in FIG. 2) is laid on the joists 14 and runs in a direction indicated by arrows 17.

FIG. 2 provides additional detail of the building wall 20 and the prior art manner in which wall 20 and joists 14 are supported on foundation 10, which extends a short distance into the underlying earth 21. Foundation mud sill plate or plates 22 are provided on foundation 10 and may be secured to joists 14, typically with nails. Sill plates 22 may be fastened to foundation 10 by anchors (not shown) which are cast into or otherwise secured in foundation 10 and extend up through sill plates 22. These anchors attempt to hold sill plates 22 to foundation 10. A rim joist member 24 covers the ends of joist 14 and is secured thereto, such as by nails. Wall 20 is supported on a wall sill plate 26 and may, typically, have stucco 28 on the exterior and plaster or wallboard 30 on the interior.

FIG. 3 shows further details of one embodiment for supporting floor beams 12 on posts 13, with joists 14 supported by beams 12. Posts 13 may bear on concrete 32 for strength and stability. The ends 16 of short joist sections may overlap atop beams 12 and be secured together, such as by nails 34.

As can be seen from the prior art connections between wall sill plate 26, floor framing joist 14, foundation mud sill plate 22 and foundation 10, shown in FIG. 2, severe seismic or wind forces impinging on wall 20 could force the building off of foundation 10, particularly where sill plates 22 are not fastened to foundation 10 or where either the foundation or the sill plates have deteriorated so that any fasteners are loose or poorly attached.

The protective system of this invention is detailed in FIGS. 1, 3, 5, 6, 8, 9 and 10. Any of several alternatives may be used in some cases, depending on conditions and the aesthetics of the location. In some highly visible locations, the seismic protective measures will be applied entirely within foundation 10. In other cases, as detailed below, protective additions that require cutting of the building exterior, such as stucco, may be preferred where the repairs are not obvious or visible from the exterior.

A deadman 38 is located adjacent to foundation 10 at any of a number of selected locations. The deadman may be inside or outside foundation 10 and may be in contact with the foundation, replace part of the foundation or be slightly spaced from the foundation, as desired and in accordance with particular circumstances. Each deadman 38 is formed from a suitable material, such as concrete, steel, wood or a combination thereof. Each deadman 38 may be cast or constructed in place or may be prefabricated. At least part of the foundation wall 10 is removed at the location of each deadman 38. While a location within the foundation is generally preferred, in some cases the deadman may be replace a section of foundation wall 10 or be placed outside and in contact with foundation wall 10. Concrete is preferred because of the resulting high weight and ease of forming by casting-in-place. Each deadman should have a sufficient volume and extend into earth 21 a sufficient distance in accordance with design values set forth in the applicable building codes, which may vary with seismic risk factors in different geographic locations.

It is generally desirable to provide pairs of deadmen 38 at opposite sides of foundation 10, and/or at opposite ends of a single joist 14. While the deadmen are preferably located adjacent to the foundation 10, they may also be used at other locations, if desired.

Figure 4:
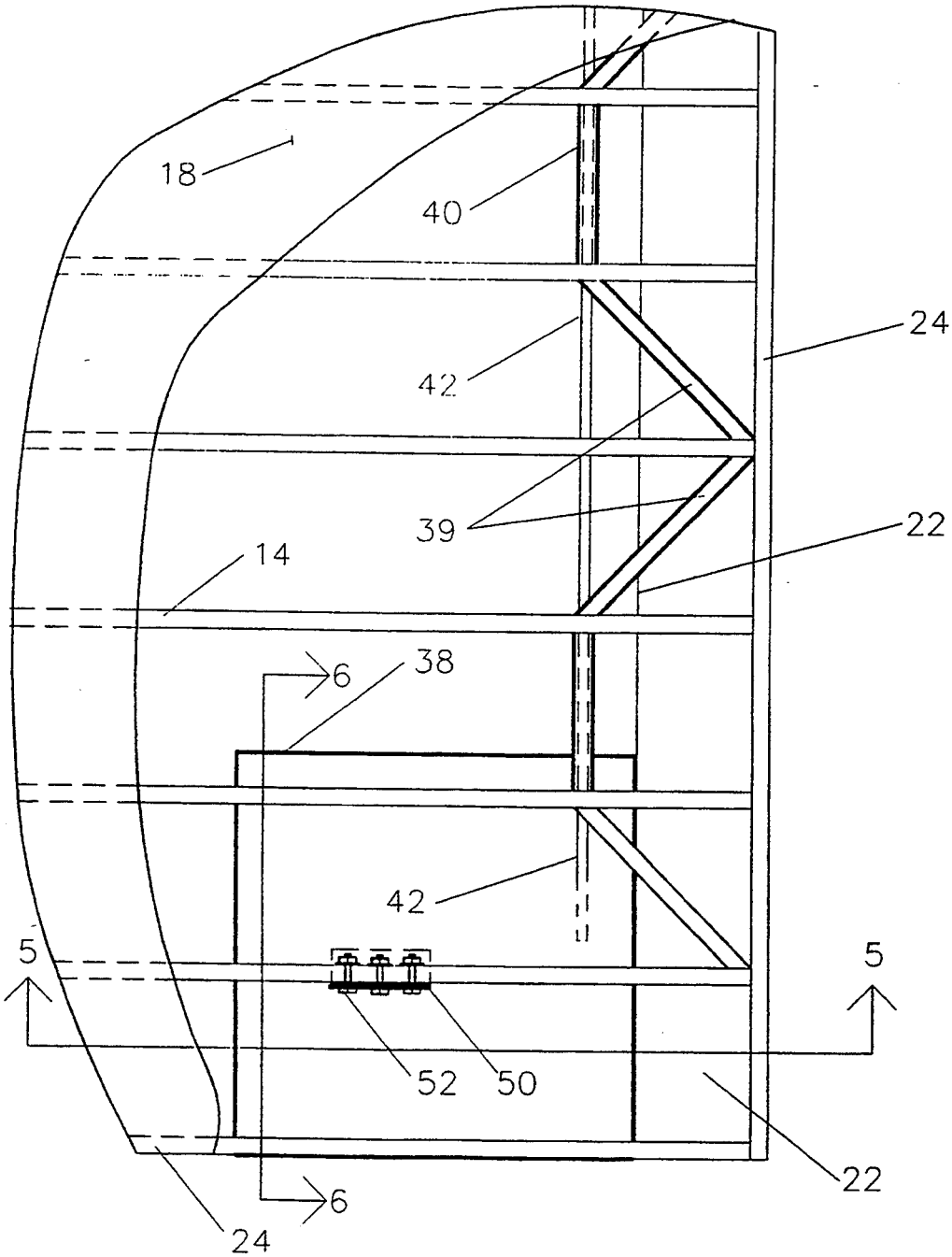
FIG. 4 is a detail plan view of a portion of FIG. 1, taken in area 4—4 in FIG. 1.

As schematically seen along the right side of FIG. 1 and in detail in FIG. 4, a plurality of diagonal pairs of compression blocks 39 and transfer blocks 40 are placed between selected joists 14 and rim joists 24. Blocks 39 and 40 are typically secured to the joists by nails or the like. Compression blocks 39 and transfer blocks 40 may be wood, metal or other materials. Typically, these blocks 39 and 40 are built up from pieces of wood fastened together as shown the angular compression blocks (39) and transfer block (40) are placed in a trapezoidal pattern with respect to the joists, with the non-parallel sides being the compression blocks (39) and the shorter inter-structure leg being the transfer block (40), and the long outer leg being the perimeter of the structure. Therefore the compression blocks (39) extend angularly inward away from the perimeter of the structure and end at the transfer block (40) which forms the short leg of the trapezoid. The transfer blocks (40) are fastened linearly between the selected joists in alignment with the inward ends of the compression blocks (39). The above language is clearly supported in FIGS.

1 and 4. Transfer tie strap 42 are fastened to the bottom or sides of transfer blocks 40. These tie straps 42 may be formed from sturdy material, such as metal or other appropriate material.

Figure 5:
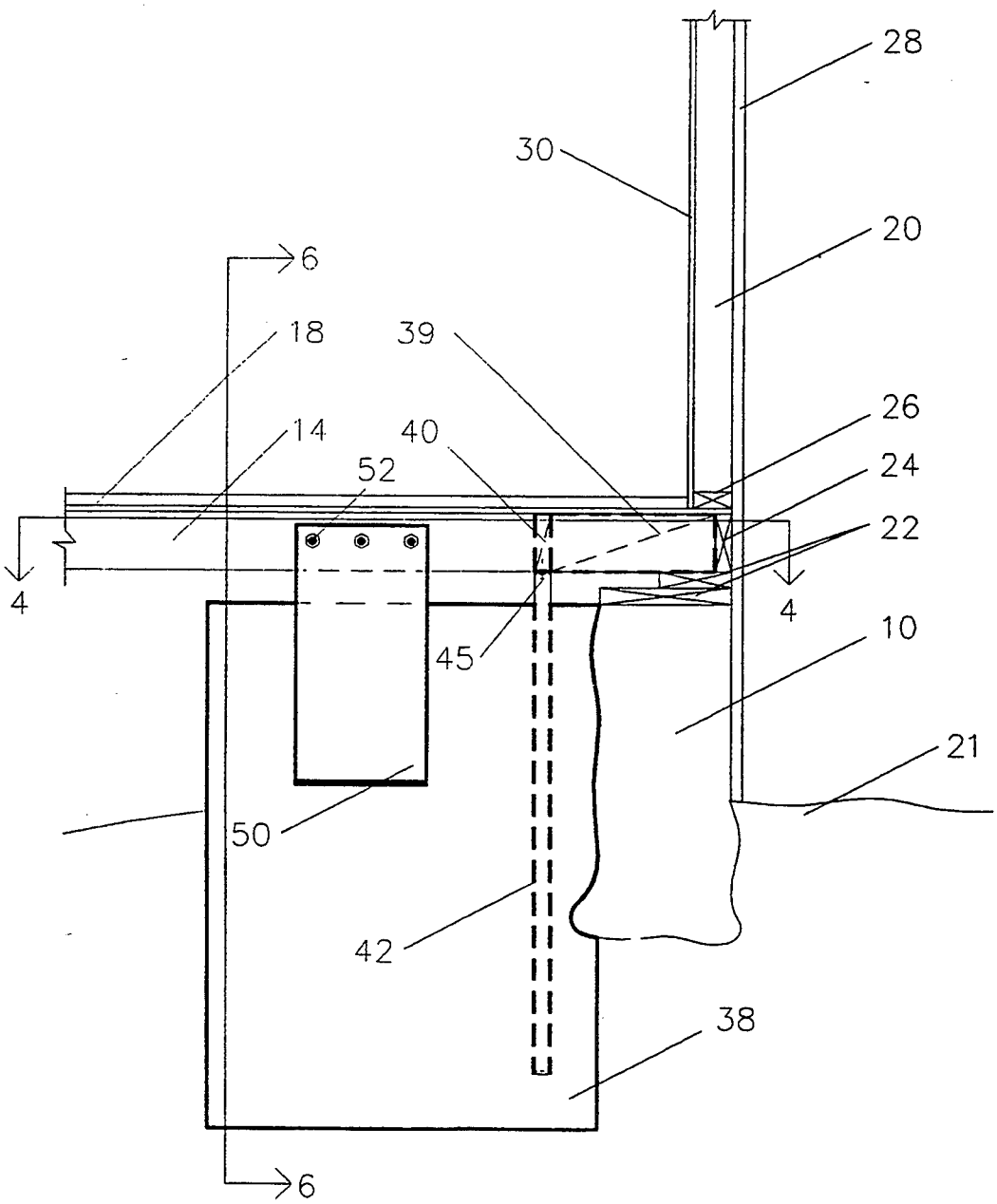
FIG. 5 is a detail section view taken on line 5—5 in FIG. 1 showing the deadman and anchor arrangement of this invention.
Figure 6:
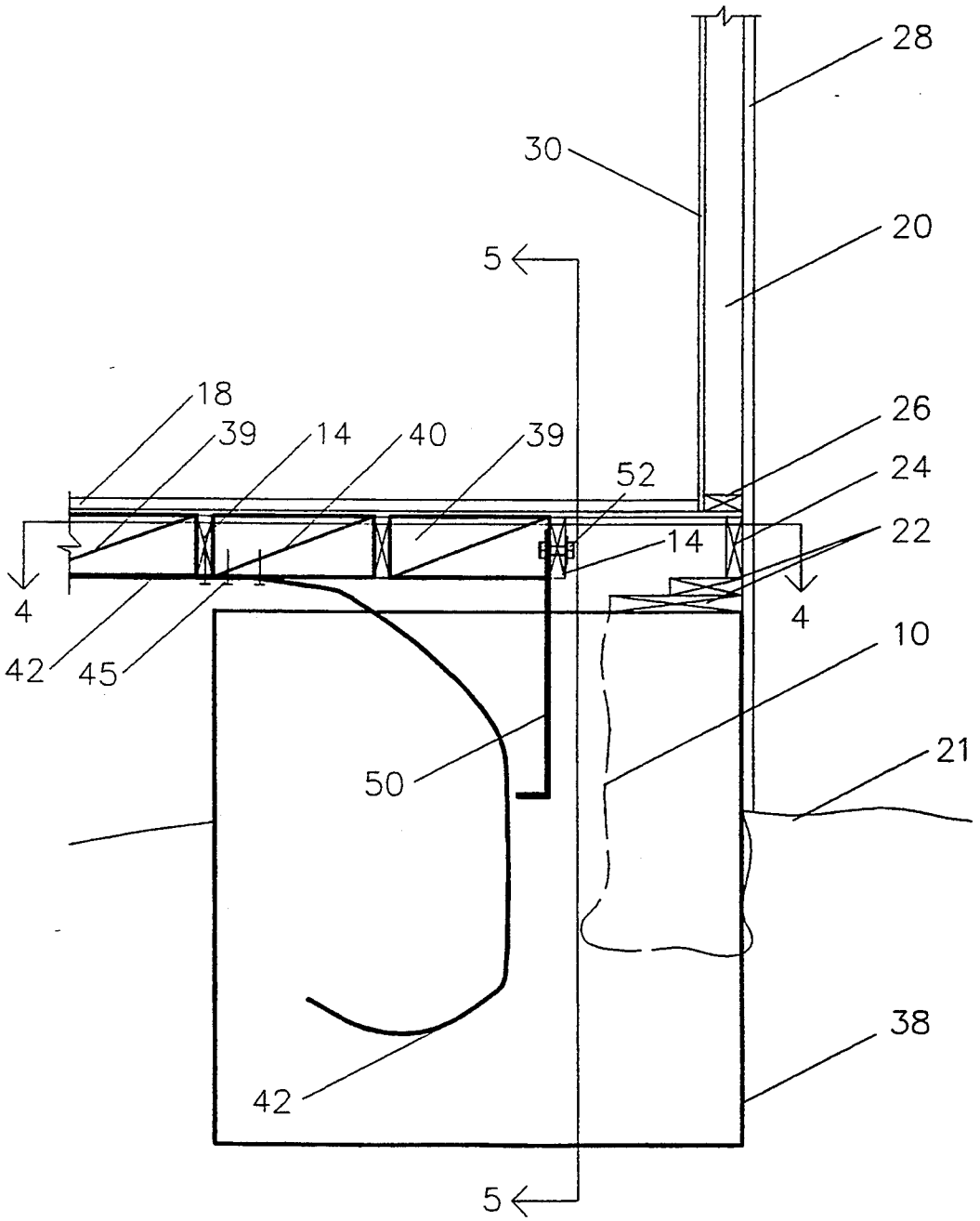
FIG. 6 is a detail section view of the deadman and anchor arrangement taken on line 6—6 in FIG. 1.

First transfer tie straps 42 are secured to deadmen 38 fastened to transfer blocks 40 by nails 45 or screws or the like, as seen in FIGS. 5 and 6. Thus, compression blocks 39 and transfer blocks 40 transfer forces to deadman 38.

Figure 8:
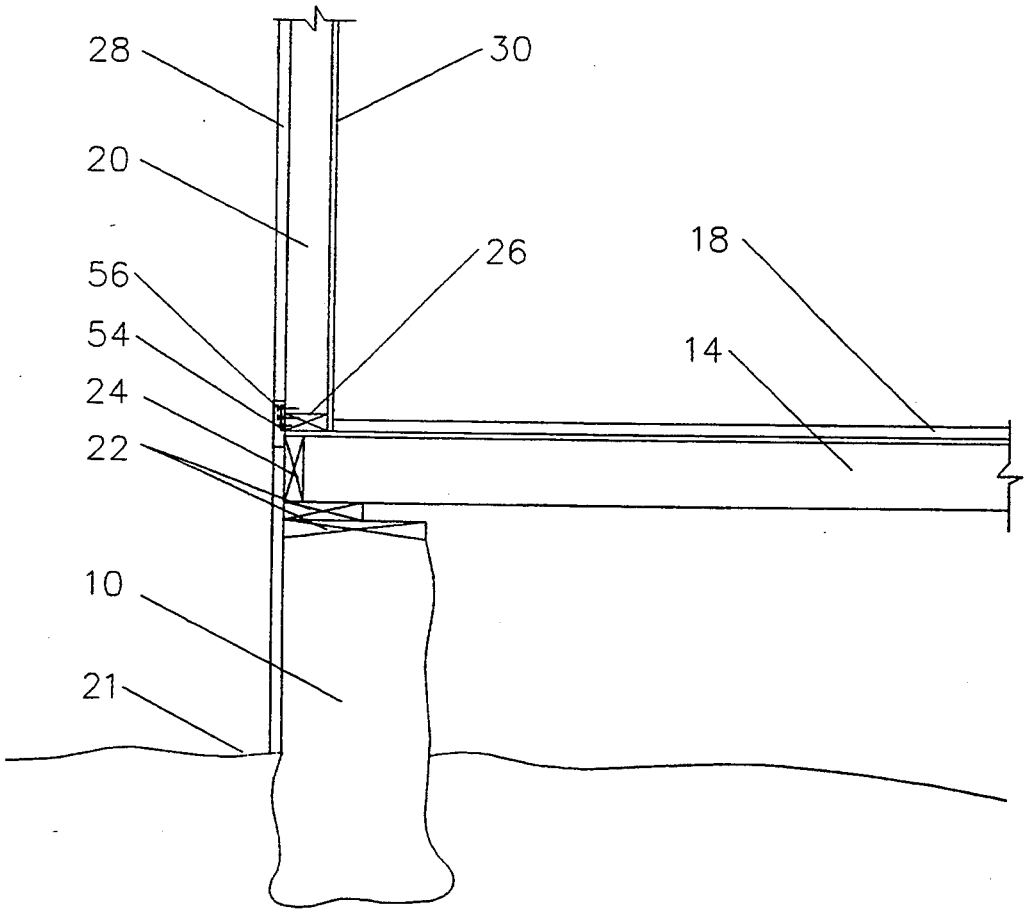
FIG. 8 is a detail section view taken on line 8—8 in FIG. 1.
Figure 10:
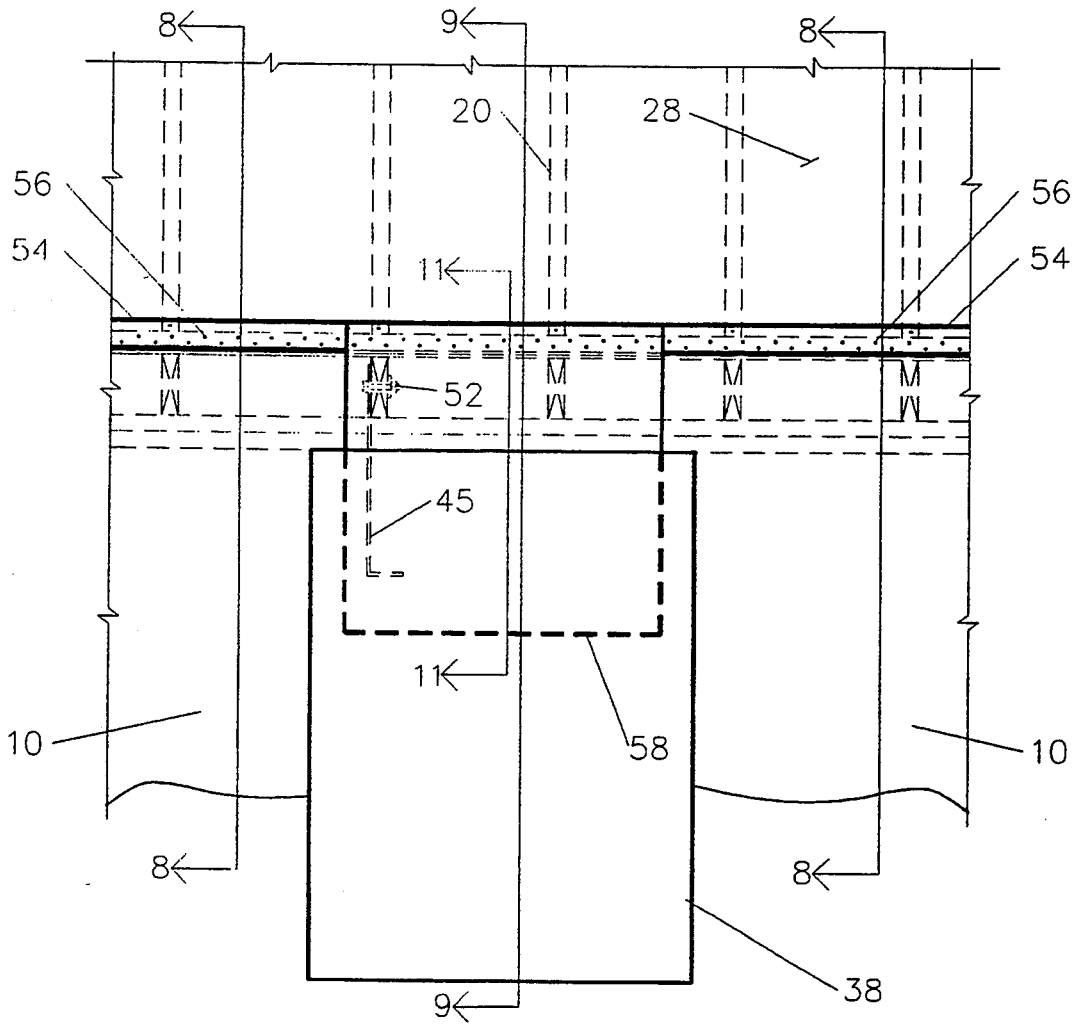
FIG. 10 is a detail section view taken on line 10—10 in FIG. 1.

As best seen in schematic representation in FIG. 1, a plurality of short transfer strap ties 48 overlap the joints between joist sections and are fastened to the joist 16, preferably by fasteners, such as bolts, that extend through the joist and short tie straps 48 to tie the entire assembly of short joist sections into one continuous joist, capable of transferring considerable forces to deadmen 38 as best seen in FIG. 4. A second anchor 50 (as best seen in FIGS. 5 and 6) is fastened to joist 14, preferably by through fasteners such as bolts 52.

Where a deadman 38 has sufficient length parallel to the foundation, more than one joist 14 may cross the deadman 38 as best seen at the left side of FIG. 1, at the top of fireplace foundation 11. In that case, each joist 14 can be secured to the deadman 38 by an anchor 50. In this way, additional forces on the building are transferred by sturdy joists to the deadmen 38 to resist movement of the building relative to foundation 10 and deadmen 38.

Where aesthetic considerations do not rule it out, the stucco or other exterior wall covering 28, as best seen in detailed section in FIG. 8, may be cut away along the wall sill plate 26 and elongated metal sill tie straps 54 can be installed, such as by nails 56, along the sill plates. Wherever a sill tie plate crosses a deadman 38, a plate angle 58 is preferably installed. Angle 58 is embedded into concrete deadman 38 and secured to metal sill tie strap 54 by a weld or lap splice 59 as best seen in FIG. 10. If required by applicable building code design and other design conditions, metal tie strap 54 may be attached to wall studs 20, rim joist 245 and foundation mud sill plate 22 or any combination thereof. The stucco or other exterior covering is replaced and repaired.

The sill tie straps could, if desired by used in conjunction with the combination of compression blocks 39, transfer blocks 40, transfer tie straps 42 and anchors 44. Of course, either the arrangement of sill tie straps 54 and plate angeles 58 could be used alone with deadmen 38, or the arrangement of compression blocks 39, transfer blocks, transfer tie straps 42 and anchors 44 could be used alone. In any of these three cases, the short tie straps 48 across overlapping ends of joists 14 between deadmen 38 with angle plates 50 fastened to the joist 14 and embedded in the deadman.

In a typical procedure for installing a seismic protection system may be varied, depending upon the building configuration and the wishes of the building owner. Such a building might, typically, be a single story, wood framed house, with a stucco exterior, plaster interior and hardwood flooring over diagonally laid boards. The subfloor framing is a 2×10 inch joist with a 16 inch spacing, bearing on perimeter concrete stem walls and interior timber beams. The concrete stem is rubble concrete with an unattached double foundation mud sill plate. The owner does not want any exterior construction at the front or left sides.

As best seen in FIGS. 1 and 8, side existing stucco is saw cut about 1 inch above and below the existing foundation mud sill plate 22. The stucco between the cuts is removed, revealing the foundation sill plates 22. A metal tie strap 54 is nailed along the sill plates, overlapping straps where necessary. If desired, stucco is also cut away along the wall sill plate 26 and a metal strap 54 is nailed therealong.

A portion of the existing rubble concrete foundation stem wall 10 is removed at selected locations and deadman form holes are excavated at those locations. A bent angle plate 58 is secured in a selected position, extending into the form for later embedment. As best seen in FIGS. 1 and 8, compression blocking 39 and transfer blocking 40 and a compression tie strap 42 are installed in the existing subfloor framing joists 14 adjacent to the left existing foundation 10. The anchor portion 44 of tie strap 41 adjacent to the deadman forms is bent down into the form for later embedment, as best seen in FIG. 6.

Figure 7:
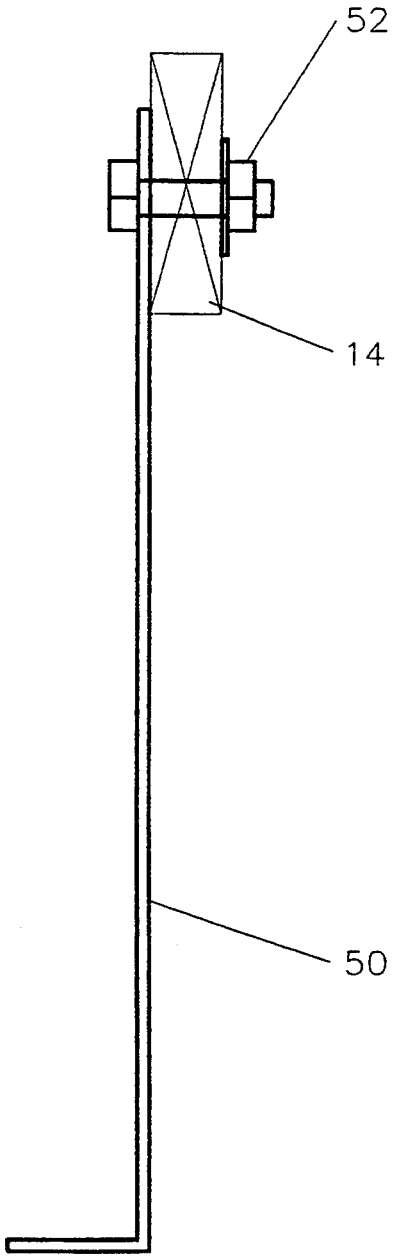
FIG. 7 is a detail view of a typical bent plate anchor for connecting structure to deadmen.

The existing joist lengths making up framing joist 14 adjacent to the existing front and back stem wall of foundation 10 are tied together with short tie straps 48. The end of existing floor joist 14 that passes over a deadman form is secured to a bent angle plate 50, as best seen in FIGS. 5 and 7.

Figure 9:
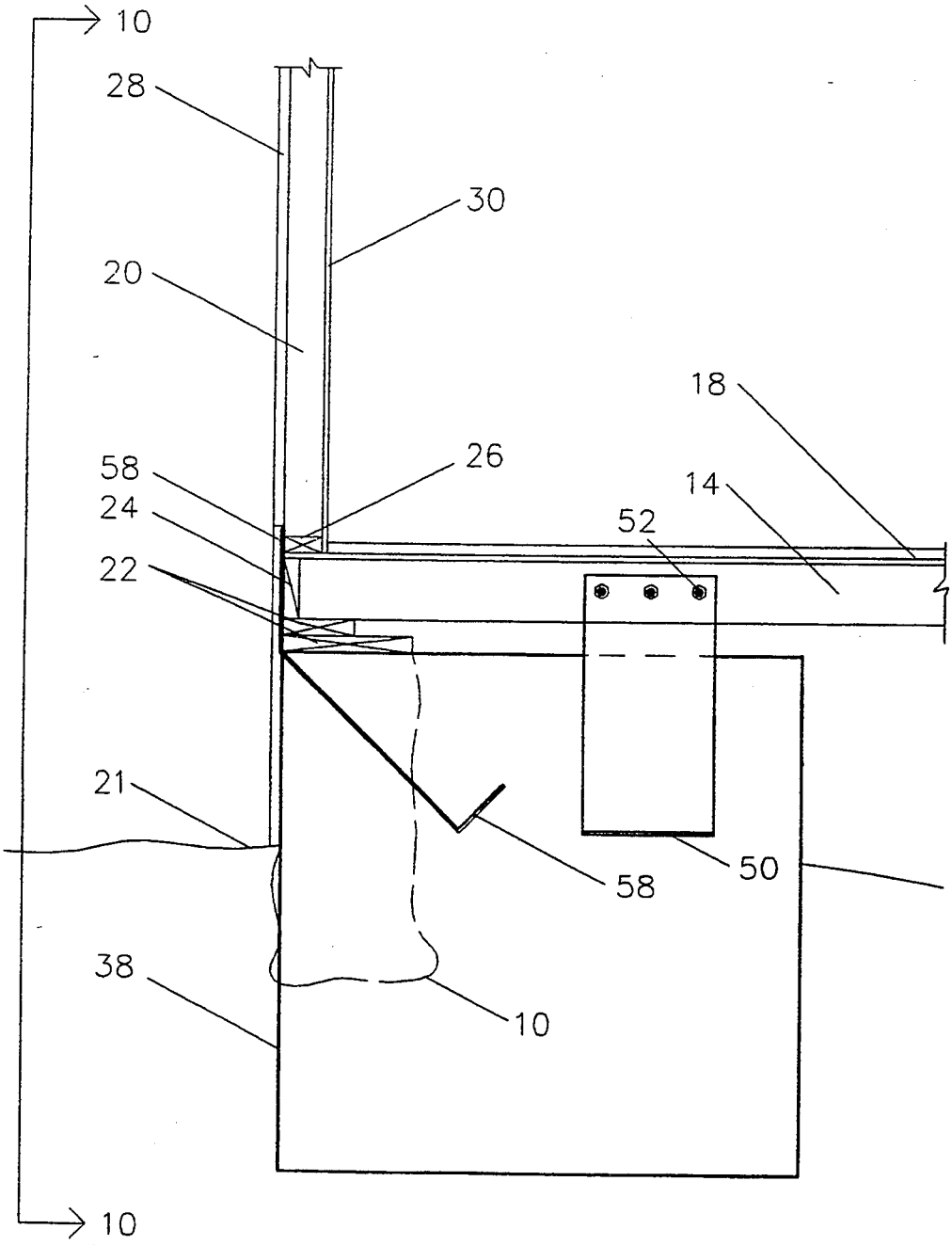
FIG. 9 is a detail section view taken on line 9—9 in FIG. 1.

Concrete is then introduced into the forms to produce deadmen 38, embedding tie strap anchors 42 and bent angle plates 50 and 58, as best seen in FIGS. 5, 6 and 9. The deadman forms are removed and a cover is placed over the wall sill plate tie strap 54, if desired, and the exterior stucco is patched. The result is a building well protected against seismic and wind forces by a selected combination of the novel features of this invention.

It should be understood that although the discussion above is directed to existing wood frame buildings the invention disclosed herein could be used on other types of construction as well as any new construction for which is applicable.

Other applications, variations and ramifications of this invention will occur to those skilled in the art upon reading this disclosure. Those are intended to be included within the scope of this invention, as defined in the appended claims.

I claim:

1. A building structure having a perimeter foundation, a plurality of parallel beams across said foundation in a first direction, rim joist members parallel to said beams at the edge of said foundation, and a plurality of parallel floor framing joists across said foundation in a second direction substantially perpendicular to said first direction, the ends of said beams and said floor framing joists supported by said foundation, and a system for providing increase structural resistance to seismic and wind forces, which comprises, (a) at least two deadman positioned adjacent to said foundation spaced apart for substantial distance along a line perpendicular to said joists and parallel to said foundation, (b) means for the transfer of forces to said deadman along said line which includes a series of compression and transfer blocks positioned between pairs of joists adjacent to said foundation, wherein, (c) said compression blocks are diagonally positioned and are the non-parallel sides of a trapezoid pattern with the inward end of the non-parallel legs extending away from the foundation inward of the structure, and which are at lease two successive spaces between pairs of joists, and secured thereto, and wherein (d) said transfer blocks which form the short leg of the trapezoid pattern are positioned between a pair of joist adjacent to at least one of said successive pairs of joists having said diagonally positioned compression blocks, said transfer blocks being in alignment with the ends of said compression blocks which extend away from the foundation and are the non-parallel sides of the trapezoid, and (e) an elongated tie strap affixed to said transfer blocks with an end of said strap being attached to one of said deadman, and (f) whereby a continuous stress absorption system of diagonally positioned compression blocks and linearly positioned transfer blocks tied to said deadman is provided.

2. The improvement according to claim 1 wherein at least some of said framing joists are made up of at least two portions connected at a joint and further including a metal tie strap covering across each joint between said separate portions making up each said framing joist and including fasteners passing through each portion at the joint and through said tie strap.

3. The improvement according to claim 1 further including at least one additional deadman located along at least one floor framing joist that passes adjacent to one of said two deadmen and an angle plate secured to said floor framing joist and embedded in each of said deadmen.

4. The improvement according to claim 1 further including foundation sill plate means lying along said foundation and supporting at least part of the beam and floor framing joists and a foundation sill strap extending along the outer edge of said foundation sill plate and secured thereto.

5. The improvement according to claim 4 further including at least one angle plate means secured at one end to said foundation sill plate and having the other end secured to said adjacent deadman.

6. The improvement according to claim 1 further including wall sill plate means supporting external wall structures and a wall sill strap extending along the outer edge of said wall sill plate and secured thereto.

7. The improvement according to claim 6 further including at least one angle plate means secured at one end to said wall sill plate and having the other end secured to said adjacent deadman.

8. A building structure according to claim 1, wherein a foundation sill plate is positioned along the upper surface of said foundation which is supported by in part by beam and floor framing joists, having a foundation sill plate strap extending along the outer edge of said foundation sill plate and secured thereto, and having at least one angle plate secured at one end of said foundation sill plate and secured to a deadman.

9. The system according to claim 8 further including wall sill plate means supporting external wall structures and a wall sill strap extending along the outer edge of said wall sill plate and secured thereto.

10. The system according to claim 9 further including at least one angle plate means secured at one end to said wall sill plate and having the other end secured to said deadman.

11. A building structure having a perimeter foundation, a plurality of parallel beams across said foundation in a first direction, rim joist elements parallel to said beams at the edge of said foundation, and a plurality of parallel floor framing joists across said foundation in a second direction substantially perpendicular to said first direction, the ends of said beams and said floor framing joists supported by said foundation, and a system for providing increase resistance to seismic and wind forces, which comprises, (a) at least two deadman positional adjacent to said foundation spaced apart for substantial distance along a line perpendicular to said joists and parallel to said foundation, and (b) means for the transfer of forces along said line along a path adjacent to and parallel to said foundation which comprises a series of rigid blocks interposed between joists to form a continuous reinforcement line between joists, and (c) an elongated tie member affixed to said blocks along said reinforcement line, and (d) said tie being affixed at its end to said deadman, whereby a continuous stress absorption system is provided adjacent to said foundation.

12. A building structure having a perimeter foundation, a plurality of parallel beams across said foundation in a first direction, rim joist elements parallel to said beams at the edge of said foundation, a plurality of parallel floor flaming joists across said foundation in a second direction substantially perpendicular to said first direction, the ends of said beams and said floor flaming joists supported on a foundation sill plate position along the upper surface of said foundation, and a system for providing increase resistance to seismic and wind forces, which comprises, (a) at least two deadman positional adjacent to said foundation spaced apart for substantial distance along a line perpendicular to said joists and parallel to said foundation, and (b) means for the transfer of forces to said deadman along said line which comprises at least one elongated tie strap affixed to said foundation sill plate and at least one angle plate having one end secured to said foundation sill plate and another end attached to said deadman, and (c) whereby a continuous stress absorption system of foundation sill plate straps tied to said deadman is provided.

13. A building structure having a wall sill plate means supporting an external wall structure, a perimeter foundation, a plurality of parallel beams across said foundation in a first direction, rim joist elements parallel to said beams at the edge of said foundation, a plurality of parallel floor flaming joists across said foundation in a second direction substantially perpendicular to said first direction, the ends of said beams and said floor flaming joists supported on a foundation sill plate position along the upper surface of said foundation, and a system for providing increase resistance to seismic and wind forces, which comprises, (a) at least two deadman positional adjacent to said foundation spaced apart for substantial distance along a line perpendicular to said joists and parallel to said foundation, and (b) means for the transfer of forces to said deadman along said line which comprises at least one elongated tie strap affixed to said wall sill plate and at least one angle plate having one end secured to said wall sill plate and another end attached to said deadman, and (e) whereby a continuous stress absorption system of wall sill plate straps tied to said deadman is provided.

* * * * *